US008302222B2

(12) United States Patent
Jasani

(10) Patent No.: US 8,302,222 B2
(45) Date of Patent: Nov. 6, 2012

(54) PATIENT TRANSFER MATTRESSES

(76) Inventor: Yogen J. Jasani, Liverpool (GB)

( * ) Notice: Subject to any disclaimer, the term of this patent is extended or adjusted under 35 U.S.C. 154(b) by 0 days.

(21) Appl. No.: 13/061,632

(22) PCT Filed: Jul. 24, 2009

(86) PCT No.: PCT/GB2009/050918

§ 371 (c)(1),
(2), (4) Date: Mar. 1, 2011

(87) PCT Pub. No.: WO2010/023467

PCT Pub. Date: Mar. 4, 2010

(65) Prior Publication Data

US 2011/0167559 A1 Jul. 14, 2011

(30) Foreign Application Priority Data

Sep. 1, 2008 (GB) ..... 0815848.7
Dec. 17, 2008 (GB) ..... 0822928.8
Jul. 24, 2009 (GB) ..... PCT/GB2009/050918

(51) Int. Cl.
*A61G 7/10* (2006.01)
*A61G 5/00* (2006.01)

(52) U.S. Cl. ..... 5/81.1 R; 5/81.1 HS; 5/706; 5/714

(58) Field of Classification Search ..... 5/81.1 R, 5/81.1 HS, 703, 704, 706, 710–713
See application file for complete search history.

(56) References Cited

U.S. PATENT DOCUMENTS 1,153,718 A * 9/1915 Silverthorn ..... 5/703
3,948,344 A * 4/1976 Johnson et al. ..... 180/124
4,172,301 A * 10/1979 Everard et al. ..... 5/712
4,272,856 A * 6/1981 Wegener et al. ..... 5/81.1 T
5,065,464 A * 11/1991 Blanchard et al. ..... 5/81.1 R
7,114,204 B2 * 10/2006 Patrick ..... 5/81.1 R
7,712,170 B2 * 5/2010 Davis ..... 5/711
7,735,164 B1 * 6/2010 Patrick ..... 5/81.1 HS
7,861,335 B2 * 1/2011 DeLuca et al. ..... 5/81.1 R
2003/0159212 A1 * 8/2003 Patrick et al. ..... 5/81.1 R
2006/0021133 A1 * 2/2006 Davis ..... 5/81.1 R
2007/0266494 A1 * 11/2007 DeLuca et al. ..... 5/81.1 R
2009/0271923 A1 * 11/2009 Lewis ..... 5/81.1 R
2010/0024123 A1 * 2/2010 Davis ..... 5/81.1 R

FOREIGN PATENT DOCUMENTS

WO 2006076686 A2 7/2006

OTHER PUBLICATIONS

International Search Report, PCT/GB2009/050918, mailed Oct. 29, 2009.

* cited by examiner

*Primary Examiner* — Robert G Santos
*Assistant Examiner* — Richard G Davis
(74) *Attorney, Agent, or Firm* — Alix, Yale & Ristas, LLP

(57) ABSTRACT

A patient transfer mattress is disclosed which includes a plurality of pods connecting the upper and lower sheets of the mattress. The pods may include a first aperture in a side wall thereof and a second aperture in an end thereof, said first and second apertures allowing air to flow from within a main cavity of the mattress and out to form a cushion of air beneath the mattress. One or more of the pods may also include a perforated disc positioned between the opposite ends thereby dividing the pod into upper and lower portions. The perforated disc controls air flow between the upper and lower portions to buffer local changes in air pressure caused by pump pressure, patient body weight or saturation.

13 Claims, 6 Drawing Sheets

Figure 5
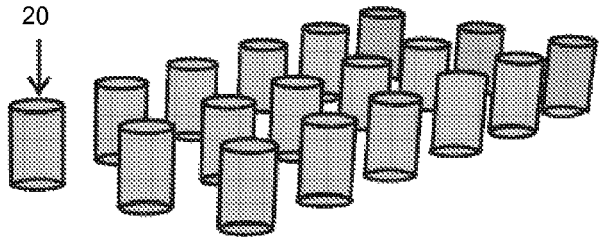
Figure 6
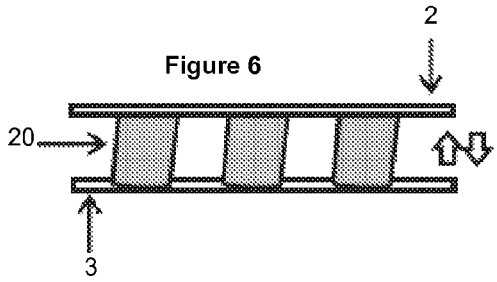
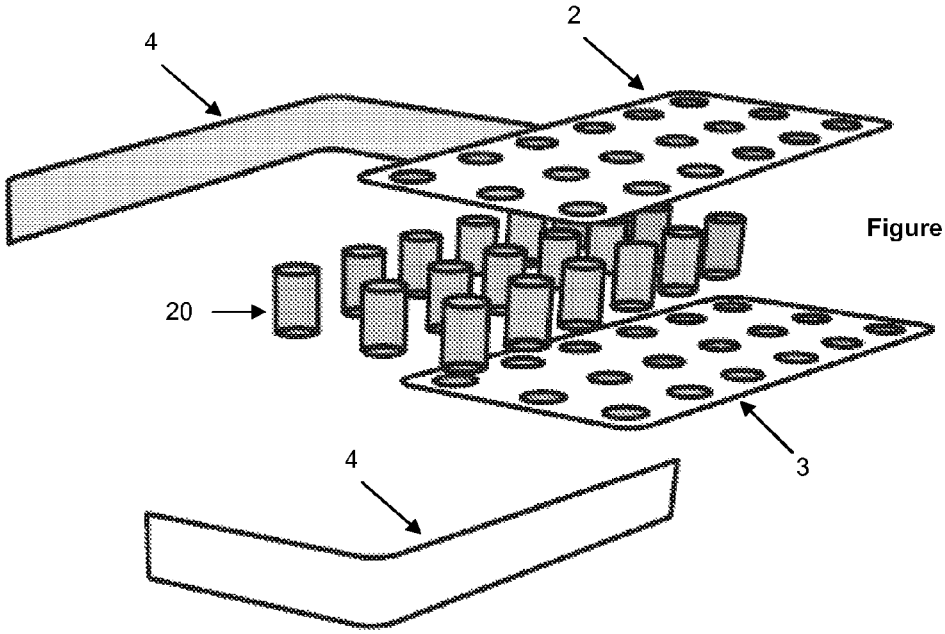
Figure 7

Figure 8
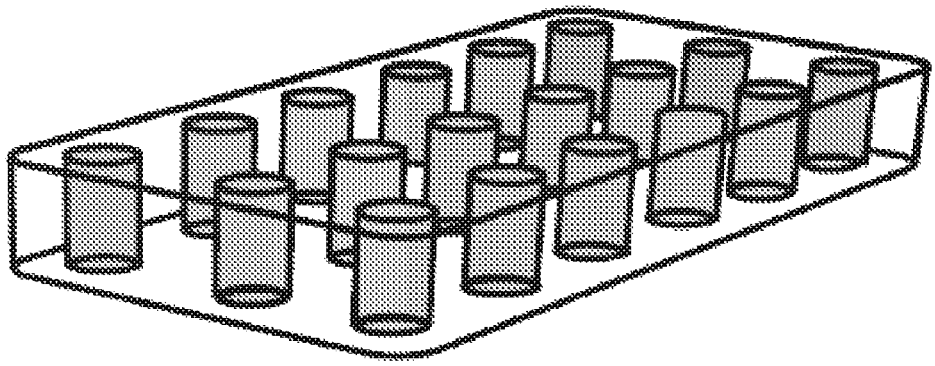
Figure 9
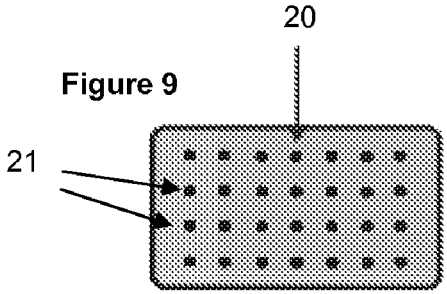
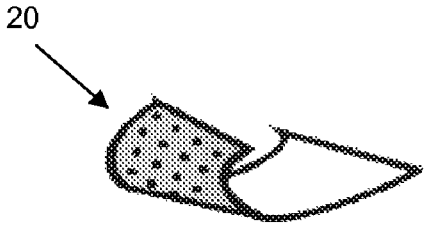
Figure 10

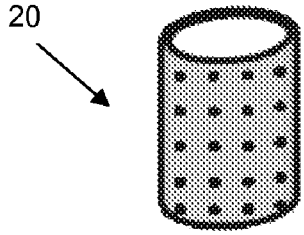
Figure 11
Figure 12
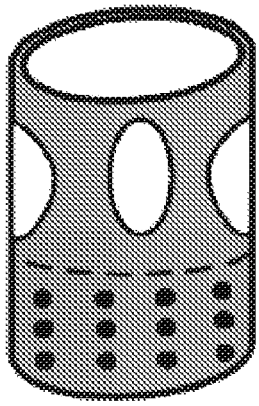
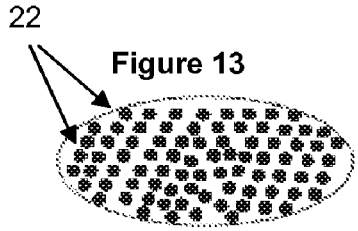
Figure 13

PATIENT TRANSFER MATTRESSES

BACKGROUND OF THE DISCLOSURE

In a hospital or other care environment, such as a nursing or residential care home, there can be problems associated with moving patients who spend much or most of their time immobile on a bed. The same problem is experienced when transferring a patient to a trolley or gurney from their bed (or vice versa).

With larger or overweight patients, the risk of injury to the patient and/or the nurses/assistants is increased, and various techniques have been employed to ease the moving process. A particular technique which has been found to be effective involves the use of an inflatable mattress, which is positioned beneath the patient. The mattress is positioned in a deflated state beneath the top sheet of the bed before the patient is placed on the bed, or the patient may lie directly on the mattress.

When it is desired to move the patient, an air pump is connected to the mattress and it is inflated. The mattress is provided, on its underside, with a plurality of pin prick perforations, which allow the pressurised air to escape from the mattress, thus creating a cushion of air which allows the mattress plus patient to be slid more easily sideways (usually) from the bed onto an adjacent trolley or vice versa. However, known patient transport mattresses (hereafter PTMs) can be of rather complex construction and are, consequently, expensive. There therefore exists a desire to realise a simpler and cheaper alternative form of PTM.

SUMMARY

According to an aspect of the present invention there is provided a patient transfer mattress, comprising an upper and lower sheet, and having disposed therebetween a plurality of pods connecting the upper and lower sheets, the pods comprising a first aperture in a peripheral wall thereof and a second aperture in an end thereof, said first and second apertures allowing air to flow from within a main cavity of the mattress and out to form a cushion of air.

Preferably, the upper and lower sheets are joined together at mutual peripheral edges.

Alternatively, the upper and lower sheets have disposed between them, and joined to them, a sidewall.

Preferably, the plurality of pods are arranged in a geometric array.

Preferably, the plurality of pods are evenly distributed.

Preferably, the plurality of pods have a plurality of apertures in their peripheral walls.

Preferably at least some of the plurality of pods are divided into two portions by a perforated disc positioned part way along the pod.

Preferably, the plurality of pods comprise a plurality of second apertures in an end thereof.

Preferably, the mattress further comprises at least one handle.

Preferably, the handle comprises a grip pivotally connected to a baseplate which is connected to the mattress by a process of stitching or welding.

Preferably, the handle further comprises at least one aperture in the baseplate through which can be fitted extension straps.

Preferably, the mattress comprises a connector connection to an air hose of an air pump for inflating the mattress.

Preferably, the connector comprises a substantially rigid tube which is either sewn or welded into the mattress and which opens into a main cavity of the mattress, defined by the upper and lower sheets.

According another aspect of the present invention, there is provided a handle for a patient transfer mattress, the handle comprising a baseplate for attachment to the patient transfer mattress, and pivotally connected thereto, a grip, wherein the baseplate further comprises an aperture arranged to receive an extension strap.

Preferably, the baseplate and grip are formed of a moulded plastics material.

Preferably, the grip is arranged to comprise a textured surface to ease user grip.

Preferably a plurality of apertures may be provided.

Preferably, the baseplate is arranged to be either stitched or welded to the mattress.

According to another aspect of the present invention, there is provided a connector for attachment to a patient transfer mattress to allow the connection of an air hose thereto, the connector comprising a substantially rigid cylindrical member open at each end with one end being arranged to feed into the interior of the mattress and the opposing end arranged to couple with the air hose.

Preferably, the connector is arranged to be stitched or welded in-situ.

Preferably, the connector comprises one half of an interlocking mechanism to ensure that the coupled air hose remains in place once fitted. The other half of the interlocking mechanism being disposed on the air hose.

For a better understanding of the invention, and to show how embodiments of the same may be carried into effect, reference will now be made, by way of example, to the accompanying diagrammatic drawings in which:

BRIEF DESCRIPTION OF THE DRAWINGS

FIG. 5 shows a view of the pods which form a part of an embodiment of the present invention;

FIG. 6 shows a cross-sectional side view of a PTM according to an embodiment of the present invention;

FIG. 7 shows an exploded perspective view of a PTM according to an embodiment of the present invention;

FIG. 8 shows a perspective view of a PTM according to an embodiment of the present invention when inflated, showing the air pods;

FIGS. 9-11 shows the construction of an air pod according to an embodiment of the present invention;

FIG. 12 shows an alternative air pod construction according to an embodiment of the present invention;

FIG. 13 shows an underside view of an air pod according to an embodiment of the present invention;

DETAILED DESCRIPTION OF THE PREFERRED EMBODIMENTS

Figure 1:
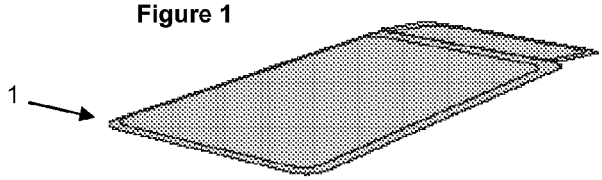
FIG. 1 shows a deflated PTM.

FIG. 1 shows a PTM in a deflated state. In this form, the PTM can be positioned immediately beneath the top sheet of the made up bed, above an under sheet or directly onto the mattress. The patient is then able to lie on the top sheet with the deflated mattress in place, but otherwise unnoticeable to the user.

Figure 2:
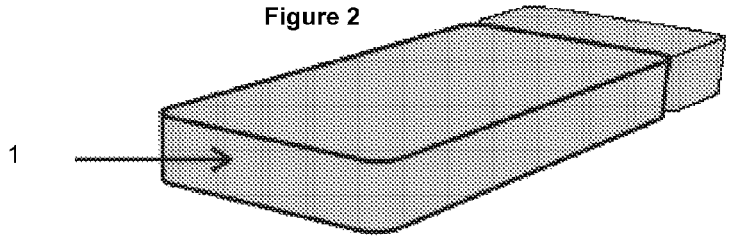
FIG. 2 shows an inflated PTM.

FIG. 2 shows the PTM in an inflated state ready to transfer the patient to or from the bed.

Figure 3:
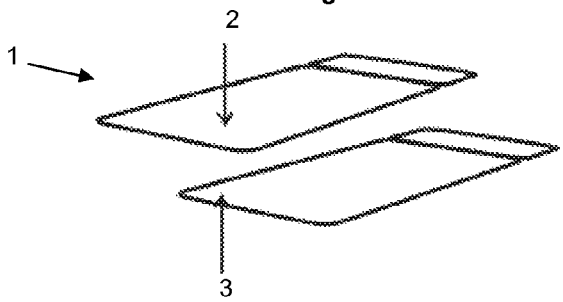
FIG. 3 shows the upper and lower sheets forming upper and lower surfaces of a PTM.

FIG. 3 shows an exploded view of the upper 2 and lower 3 sheets which form the exterior of a PTM 1 according to an embodiment of the present invention. In one embodiment, the outer edges of the upper and lower sheets are joined by stitching, welding or other treatment to form a sealed unit. In another embodiment, one or more sidewalls are positioned between the upper 2 and lower 3 sheets. The operation of the PTM is essentially identical in each case.

Unlike prior art PTMs which have a complex arrangement of baffles and pathways located within the mattress to ensure that the air flow is maintained in a manner to sufficiently inflate the mattress, embodiments of the present invention have a much more straight forward structure which essentially treats the interior of the mattress as a single space with a plurality of pods located within the core of the mattress. These pods take the form of cylindrical members which join the upper and lower portions of the mattress so that, when inflated, the mattress does not balloon out of shape and the distance between the upper and lower surface is maintained by the presence of the pods. Use of the pods in this way ensures the upper surface of the mattress, when inflated, is kept a substantially standard distance from the lower surface of the mattress and ensures that the upper surface is substantially flat and retains the patient in a safe position.

The amount of airflow which is provided through the pods can be varied by varying the dimensions of the pods. The dimensions and features which can be altered include the height and width of the pod as well as the nature and the number of the perforations provided in the side walls and the lower part of the pod.

Depending on the market which the PTM is sold into, the default configuration can be altered, or a variety of differently rated PTMs can be provided. There is, for example, a large difference between a typical North American male patient and a South-East Asian female patient, and different PTM can be provided to account for this.

Furthermore, one or more plugs may be provided which can be used to close off one or more of the lower parts of the pod 20. In this way, air flow can be directed more towards the portions of the mattress which require it and so, unlike prior art PTMs, embodiments of the invention can be altered dynamically which they are in use to deal with particular patient body types. The plugs are manufactured from a suitable foam or plastics material and are anti-static, anti-microbial and waterproof, allowing them to be re-used many times.

Figure 4:
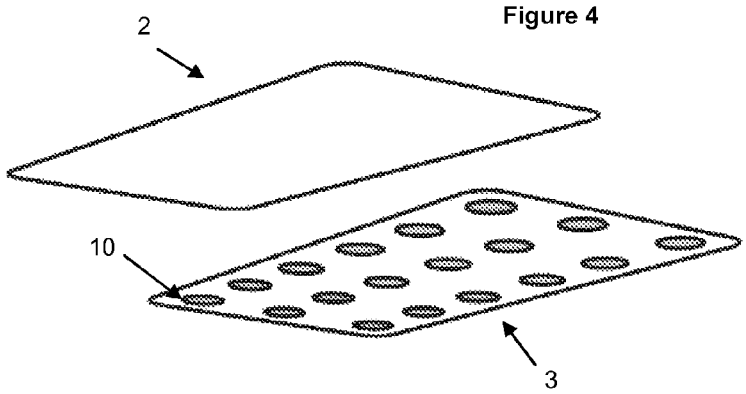
FIG. 4 shows the upper and lower sheets of a PTM according to an embodiment of the present invention.

FIG. 4 shows, by means of a plurality of shaded areas, the positions 10 occupied by the air pods, with respect to the upper and lower sheets of the PTM. FIG. 5 shows the layout of the air pods 20, within the interior of the PTM 1

FIG. 6 shows a side, sectional, view of the inflated PTM. The air pods 20 are located between the upper 2 and lower 3 sheet of the PTM and act to ensure a substantially constant distance between the upper and lower sheets. That is to say, that the air pods 20 secure the upper and lower sheets together and ensure that the mattress maintains a substantially flat upper surface for supporting the patient.

FIG. 7 shows a completely exploded view of a PTM according to the present invention. This embodiment, referred to previously, includes sidewall members 4, which are disposed between the upper 2 and lower 3 sheets of the PTM, so that the inflated PM has a substantially rectangular cross-section. These side walls 4 are optional and, instead, the upper and lower sheets may be joined directly at their peripheral edges. FIG. 8 shows a partly sectional view of the inflated PTM.

In contrast to prior art PTMs which comprise a plurality of pin prick perforations dispersed about the underside of the mattress, the pods 20 serve a further purpose in acting as a conduit for release of pressurised air from the underside of the mattress, thereby creating the cushion of air upon which the mattress and patient can be moved.

In one embodiment, the cylinder, which forms the pod, comprises a flat, substantially rectangular, portion of material which is rolled into an open ended cylinder. The adjoining ends are then sealed together. The upper and lower open ends of the cylinder are then attached to the inner surfaces of the upper and lower sheets, respectively, of the mattress. This procedure and arrangement is shown in FIGS. 9, 10 and 11. FIG. 9 shows the starting material which comprises a planar rectangular section of material, which is perforated. The perforations 21 are distributed evenly across the rectangular section.

The upper end of the cylinder is attached to an inner surface of the upper sheet and so is closed. The lower surface of the cylinder, in one embodiment, is perforated with a plurality of pin prick perforations 22 to allow air to escape from the main body of the mattress through the perforations 21 in the side walls of the cylinder 20 and out through the plurality of perforations 22 located on the underside of the PTM. This is shown in FIG. 13. It is possible to replace the plurality of pin prick perforations 21, with a smaller number of larger apertures. It is found that providing 3 or 4 larger apertures works well.

In a further embodiment, the lower end surface of the cylinder is removed entirely, leaving one aperture which is substantially similar in size to the interior of the cylinder. In either of these two embodiments, pressurised air is released from the underside of the mattress, creating a cushion of air upon which the mattress and patient can effectively hover and thus be moved more simply.

FIG. 12 shows a further possible embodiment, which is a form of combination of the two previously described embodiments, and uses different configurations of perforations in the cylindrical pods. FIG. 12 shows a pod whereby an upper portion of the pod comprises a relatively small number of relatively large apertures whilst the lower portion of the pod comprises a relatively large number of smaller pin prick style perforations. Positioned between the two perforation zones, and shown by the dotted line, is a perforated disc (which appears identical to the underside view of the pod shown in FIG. 13), which is welded or otherwise attached to the interior of the pod. By providing this additional disc, the pod is able to act as a buffer so that air from the upper portion of the pod is only released slowly through the perforations in the disc, while there is a continuous airflow through the plurality of pinprick perforations located in the lower portion of the pod.

In a further embodiment of the present invention, the pod shown in FIG. 12 is further adapted so that the perforations in the lower portion of the pod are removed and the walls of the pod in the lower portion are substantially impervious to the flow of air. The perforated disc still provides the division between the upper and lower portions, and the upper portion still has one or more apertures therein, but it is found that this arrangement, with no perforations in the lower portion of the pod, provides a still further improvement in the performance of the PTM.

In effect, in all of the embodiments where there is a division between an upper and lower portion of the pod 22, the upper portion of the pod acts as a storage chamber with the air contained therein being released through the perforated disc and from the lower open portion of the pod in one of the following three ways: pressure (air flow from the air pump); patient body weight; or saturation.

In this way, the stored air in the upper portion of the pod is released generally only when required, for example when the patient moves or shifts their weight around on the PTM. The position of the perforated disc, dividing the upper and lower portions of the pod, can be moved as needed and the perforations in the upper chamber can be a plurality of pinprick perforations or one or more larger apertures as required. A certain amount of experimentation may be required to find the optimum performance for a given range of patient weights and/or materials of the PTM.

This arrangement and the embodiment shown in FIG. 12 has the advantage that any movement of the patient, for instance, which can create localised high pressure areas, which can cause the PTM to 'ground', can be absorbed by the buffer effect of the pod.

Furthermore, if the PTM requires customisation to provide additional uplift in certain areas, then one or more of the large apertures at the base of the pods 20 can be blocked using a suitable stopper, thereby diverting airflow more to the remaining pods and so increasing uplift in their vicinity. A suitable stopper may be manufacture from a foam or plastics material. For instance, it may be found that by blocking a plurality of apertures around the perimeter of the PTM, increased uplift can be provided at a central region, which may help with certain body-types.

Figure 14:
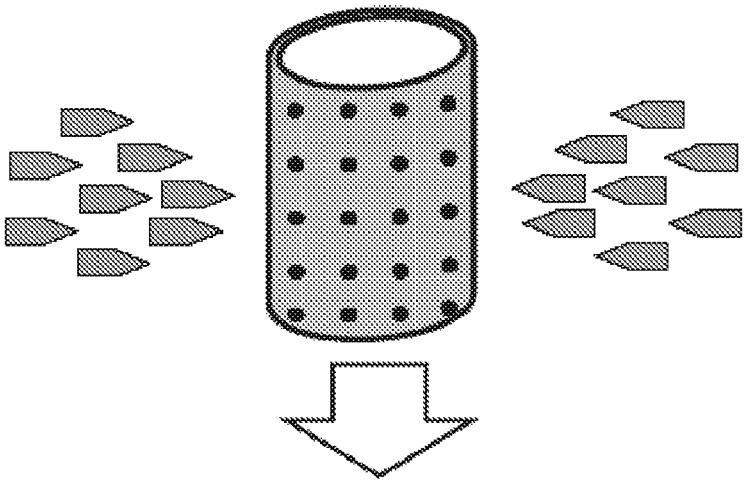
FIGS. 14 and 15 show the mode of operation of the air pods shown in FIGS. 11 and 12 respectively.
Figure 15:
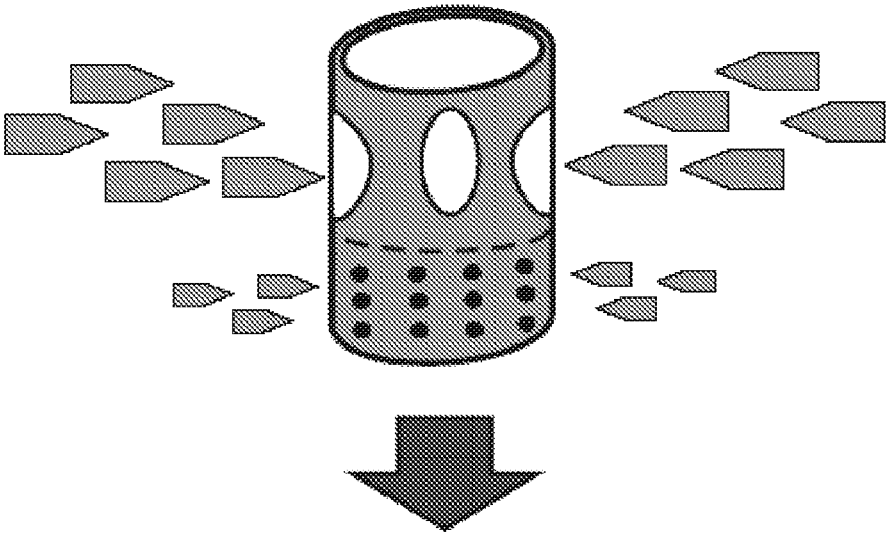

FIGS. 14 and 15 show the operation of the pods 20, with pressurised air, indicated by the arrows, permeating the perforations 21 of the side walls of the pods and being ejected from the lower part of the pod, thereby creating a cushion of air. FIG. 15 shows how the buffering effect is achieved. The bulk of the air entering the pod is from the upper portion, with a smaller amount coming from the lower portion. There is more resistance to air leaving the pod through the perforated disc, which provides the buffering effect referred to.

The material used to construct the PTMs can be one or more of a variety of material which can be sewn or welded together. Furthermore, to ensure the longevity of the PTM over numerous laundry cycles, it has been found that the following materials are particularly preferred:

1. Nylon and/or Polyester (and blends of different types of Nylon and/or Polyester) coated with PVC (weldable and/or otherwise) and/or Polyurethane (weldable and/or otherwise).
2. Nylon and/or Polyester (and blends of different types of Nylon and/or Polyester) treated with one or more of: Anti-Microbial; Anti-Static; Water Repellent; Flame Retarding Chemical; and/or then coated with PVC (weldable and/or otherwise) and/or Polyurethane (weldable and/or otherwise).
3. Cotton and/or Poly Cotton and/or Blends of other Synthetic Fibres with Cotton on its own, treated with one or more of the above chemicals (from paragraph above) and/or coated with any one of the above (PVC and/or Polyurethane—weldable and/or otherwise).
4. Nylon and/or Polyester and/or Blends of treated with Silicone (and/or other friction reducing chemicals) used alone and/or treated with one or all of the above chemicals and/or coated with any one of the above (PVC and/or Polyurethane—weldable and/or otherwise).
5. Non Woven Materials (for example Spun Bond and/or Needle Punch Fabrics—using Nylon and/or Polyester combined with Viscose) used on their own or could be treated with Silicone and/or treated with one or more of: Anti-Microbial; Anti-Static; Water Repellent; Flame Retarding Chemical and/or then coated with PVC (weldable and/or otherwise) and/or Polyurethane (weldable and/or otherwise)
6. PVC and/or Polyurethane treated with various chemicals noted above.

Non Woven Materials are preferred to make PTMs for single patient use. PTMs from this material could be used where there is a risk of infection and contact with bodily fluids. In this instance the non woven materials would not be treated with Anti-Microbial, Water Repellent and Flame Retarding Chemicals because the product would be discarded after it was soiled and dirty.

Anti-Static treatments may be required if the PTM is to be used in an operating room (OR) or theatre because of the potential use of flammable gasses.

The material of the PTM may be treated, by coating, with Silicone or similar materials to provide friction reducing properties. Such friction reducing properties are very useful when installing and removing the mattress. For example, in cases when the mattress needs to be put in place beneath a patient who is already in-situ, then most patients would need to be log rolled on and off the mattress. This process (and other techniques for applying and removing sliding sheets are well known) are generally easier if the material is treated with a friction reducing material such as silicone.

Nylon and/or Polyester are preferred to make products that can readily be reused i.e. is they can be disinfected, cleaned, washed and dried. Heavier weight fabrics of Nylon and Polyester generally allow for increased longevity. However lighter weight fabrics would allow for easier handling and cleaning but the longevity may be compromised. This is dependent on use and the frequency of laundry and, more particularly, drying which has a more damaging effect on the material.

Anti-Microbial chemicals can be used to aid infection control issues. Flame Retardant compounds can be added for some situations as mentioned previously.

A water repellent material can help prevent the mattress from becoming soiled and also facilitates in cleaning. For example, it is easy to wipe clean a soiled mattress with a cleaning wipe and/or liquid spray.

The PTM 1 is provided with one or more handles to facilitate grasping of the mattress and its associated sliding movement from bed to trolley. Prior art PTMs tends to use textile handles whereas embodiments of the present invention utilise moulded plastics material handles which can either be welded directly to the plastics material of the mattress or can be made in a format which is stitchable between the upper and lower sheets of the mattress or the upper or lower sheet and the side wall, if provided.

Figure 16:
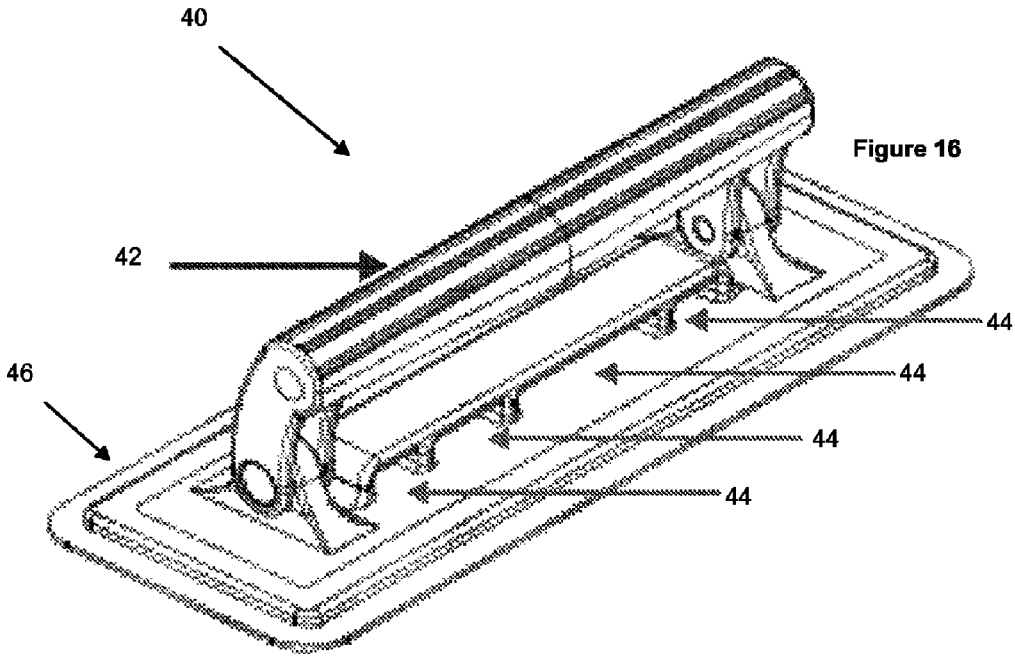
FIG. 16 shows a handle according to an embodiment of the present invention.
Figure 17:
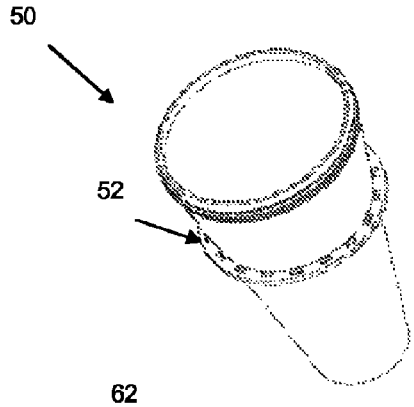
FIG. 17 shows a PTM air pump connector according to an embodiment of the present invention.
Figure 18:
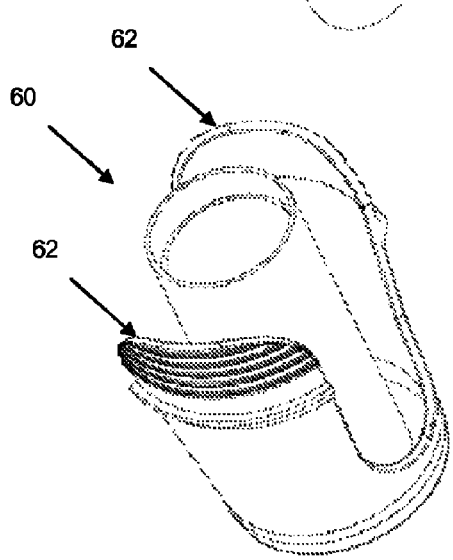
FIG. 18 shows an air pump connector according to an embodiment of the present invention.

FIG. 16 shows a handle according to an embodiment of the preset invention. The handle 40 comprises a backplate 46, to which is pivotally attached a grip 42. The backplate and grip are formed from a rigid plastics material, which is preferably moulded. The grip 42 is provided with a plurality of grooves or ridges, which aid the user's grip and make for an ergonomic, non-slip, design.

Also provided as part of the backplate 46 is a plurality of notches 44, which allow extension straps and the like to be easily fitted to the handle. Examples of situations where additional straps may be required, includes cases where it is difficult for a user to reach across a trolley or gurney to reach the handles and by fitting extension straps to the handles to pre-configured apertures 44, then the mattress can be manoeuvred more conveniently and safely for the users.

An advantage of handles formed from a moulded plastics material is that the shape can be controlled to provide a comfortable and ergonomic fit for the user's hand.

Typically, at least one pair of handles will be provided on each side of the mattress, thereby ensuring that the mattress can be easily grasped and moved from either of its sides.

In another embodiment, the moulded plastics handle is configured essentially to resemble a number "3" character. In this way, each handle is actually provided with two portions which can be grasped by the user. By using a handle of this configuration, it is preferable to provide three such handles along each side of the mattress. A first is positioned towards a top end; a second is positioned towards a bottom end; and a third is positioned approximately mid way between these two. In this way, if two people are required to grasp and move the mattress, each can have one hand on the central handle and the other hand on the upper or lower handle respectively. This provides an ergonomic and convenient way of grasping and moving the mattress.

In order to inflate the mattress into a state where it can be used to move a patient, it is necessary to attach to it a continuous air pump. The air pump is basically a means by which pressurised air can be delivered to the mattress continuously for the duration of the patient transfer. The air pump is preferably powered from a mains electric source, although it is possible for it to be powered from a battery if necessary. The air is delivered from the pump via a flexible hose which is terminated in a connector 60, which attaches to a complementary connector 50 positioned at a convenient location on the mattress, typically at the foot end of the mattress. The connector which is integrated with the mattress takes the form of an open cylindrical tube having one open end protruding from the mattress for connection with the air pump.

The air pump which is used to inflate the PTM uses a variable output power, typically in the range 700 watts to 1500 watts. The variability of the output power is useful in configuring the PTM to a specific patient, whereby a greater degree of uplift is generally required for a heavier patient and a lower degree of uplift is generally required for a lighter patient.

Prior art PTMs tend to utilise a standard output air pump and the PTMs themselves are not susceptible to variation of the air pressure since the internal construction can fail under increased pressure conditions and the apertures through which the air escapes to create the air cushion can deform on higher pressures and close in extreme circumstances. As such, the generally counter intuitive effect of degraded performance at higher pressure is experienced.

The embodiments of the present invention, utilising a variable output air pump, these problems are not experienced due to the different nature of the internal construction of the PTM. This, combined with the ability to close off selected ones of the lower apertures, means that the performance of the PTM can be fine tuned to match the characteristics of the given patient.

The other end of the open cylinder feeds directly into the main cavity of the mattress and allows the pressurised air to circulate therein. The connector is formed from a suitably rigid or semi-rigid plastics material and can either be welded to the material of the mattress or alternatively it can be stitched in place, if this is preferred. Since the mattress is only operable with a continuous flow of air, there is no requirement for a stopper to close off the connector when not in use and it can quite readily be left open when the mattress is in a deflated state.

To fit the connector 60 to the complementary connector 50, the pair of wings 62 are squeezed together as the connector 60 is inserted. The wings then provide a secure fit and prevent the air hose from escaping when the air pump is activated.

In an alternative embodiment, the upper surface of the PTM is provided with an additional chamber, separate from the main chamber. This uppermost chamber may be separately inflatable to the main chamber and arranged to retain air to provide a cushioned surface when the main chamber is deflated and may otherwise be uncomfortable to lie on. The additional chamber may, alternatively, be filled with gel or foam.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A patient transfer mattress, comprising an upper and lower sheet defining a main cavity therebetween, and having disposed therebetween a plurality of pods having opposite ends connecting the upper and lower sheets, the pods comprising a first aperture in a peripheral wall thereof and a second aperture in an end thereof, said first and second apertures allowing air to flow out from within the main cavity to form a cushion of air, wherein at least some of the plurality of pods comprise a perforated disc positioned between the opposite ends thereby dividing the pod into upper and lower portions.

2. The patient transfer mattress of claim 1, wherein the upper and lower sheets are joined together at mutual peripheral edges.

3. The patient transfer mattress of claim 1, further comprising a sidewall disposed between and joining the upper and lower sheets.

4. The patient transfer mattress of claim 1 wherein the plurality of pods are arranged in a geometric array.

5. The patient transfer mattress of claim 4 wherein the plurality of pods are evenly distributed.

6. The patient transfer mattress of claim 1 comprising a plurality of apertures in the peripheral walls of the pods.

7. The patient transfer mattress of claim 1 wherein the second aperture extends substantially to the peripheral wall.

8. The patient transfer mattress of claim 1, wherein the lower portion has no perforations in its peripheral wall.

9. The patient transfer mattress according to claim 1 further comprising at least one handle disposed on an outer surface of the mattress.

10. The patient transfer mattress of claim 9 wherein the handle comprises a grip pivotally connected to a baseplate which is connected to the mattress by stitching or welding.

11. The patient transfer mattress of claim 10 wherein the handle further comprises at least one aperture in the baseplate configured for optional receipt of extension straps.

12. The patient transfer mattress of claim 1 further comprising a connector configured for connection to an air hose of an air pump for inflating the mattress.

13. The patient transfer mattress of claim 12 wherein the connector comprises a substantially rigid tube defining a passage, the tube being sewn or welded into the mattress and the passage opening into the main cavity of the mattress sheets.

* * * * *